US006860052B1

(12) United States Patent
Conner et al.

(10) Patent No.: US 6,860,052 B1
(45) Date of Patent: Mar. 1, 2005

(54) TEARGAS DEPLOYING ASSEMBLY

(76) Inventors: Zachary B. Conner, 32141 N. Big Oak La., Castaic, CA (US) 91384; Brian Walker, 32141 N. Big Oak La., Castaic, CA (US) 91384

( * ) Notice: Subject to any disclaimer, the term of this patent is extended or adjusted under 35 U.S.C. 154(b) by 0 days.

(21) Appl. No.: 10/672,872

(22) Filed: Sep. 29, 2003

(51) Int. Cl.[7] ..... F41C 9/00
(52) U.S. Cl. ..... 42/1.08
(58) Field of Search ..... 42/1.08, 1.15; 89/1.2, 1.25, 1.11, 1.1

(56) References Cited

U.S. PATENT DOCUMENTS

| | | | | |
|---|---|---|---|---|
| 2,491,516 A | * | 12/1949 | Piggot et al. | 134/24 |
| 2,813,753 A | | 11/1957 | Roberts | |
| 3,530,580 A | * | 9/1970 | Shelnick | 30/359 |
| 3,833,064 A | | 9/1974 | Ranney, Jr. | |
| 4,046,055 A | * | 9/1977 | McDanolds et al. | 86/50 |
| 4,316,404 A | | 2/1982 | Medlin | |
| 4,353,283 A | | 10/1982 | Crepin | |
| 4,485,877 A | | 12/1984 | McMillan et al. | |
| 4,598,096 A | * | 7/1986 | Grant | 514/715 |
| 4,676,319 A | | 6/1987 | Cuthbertson | |
| 5,105,716 A | | 4/1992 | Hahn et al. | |
| 6,581,521 B1 | * | 6/2003 | Dixon et al. | 102/368 |
| RE38,247 E | * | 9/2003 | Wickser, Jr. | 42/95 |

FOREIGN PATENT DOCUMENTS

| | | | |
|---|---|---|---|
| DE | DL 33 380 | * 10/1964 | 42/1.08 |

* cited by examiner

*Primary Examiner*—Stephen M. Johnson

(57) ABSTRACT

A teargas deploying assembly includes an elongated tubular member having a first end and a second end. The first end is closed and has a pointed shape. The second end is open. A plurality of apertures extends into the tubular member and each is positioned generally adjacent to the first end. A canister receiving housing is fluidly coupled to the second end and extends away therefrom. A teargas canister may selectively be positioned into the housing. A male bracket is attached to the housing for removably mounting the housing to the female receiver such that the tubular member extends away from the vehicle. The first end of the tubular member may be extended through a wall such that teargas released from the canister may enter a dwelling bound by the wall.

4 Claims, 2 Drawing Sheets

TEARGAS DEPLOYING ASSEMBLY

BACKGROUND OF THE INVENTION

1. Field of the Invention

The present invention relates to gas deploying devices and more particularly pertains to a new gas deploying device for allowing a raiding party to inject teargas through a wall so that the security personal are not subjected to increased risks when deploying teargas.

2. Description of the Prior Art

The use of gas deploying devices is known in the prior art. Typically, these are ejected from air cannon type devices and rely on the accuracy of the person firing the device to ensure that the teargas canister being fired finds its way through a window. Another method of deploying teargas is to ram a wall with an armored vehicle to create and opening into which teargas may be thrown.

While these devices and methods fulfill their respective, particular objectives and requirements, the need remains for a device that allows teargas to be deployed into a dwelling or other structure without exposing the personnel performing the deploying task to increased risks while performing the task.

SUMMARY OF THE INVENTION

The present invention meets the needs presented above by incorporating a device that utilizes an armored vehicle to puncture a wall and inject teargas through the wall and into the dwelling. The armored vehicle will ensure that the deploying personnel are not exposed to risks from gunfire while the present invention will ensure that the teargas is effectively deployed within the dwelling.

To this end, the present invention generally comprises an elongated tubular member having a first end and a second end. The first end is closed and has a pointed shape. The second end is open. A plurality of apertures extends into the tubular member and each is positioned generally adjacent to the first end. A canister receiving housing is fluidly coupled to the second end and extends away therefrom. A teargas canister may selectively be positioned into the housing. A male bracket is attached to the housing for removably mounting the housing to the female receiver such that the tubular member extends away from the vehicle. The first end of the tubular member may be extended through a wall such that teargas released from the canister may enter a dwelling bound by the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
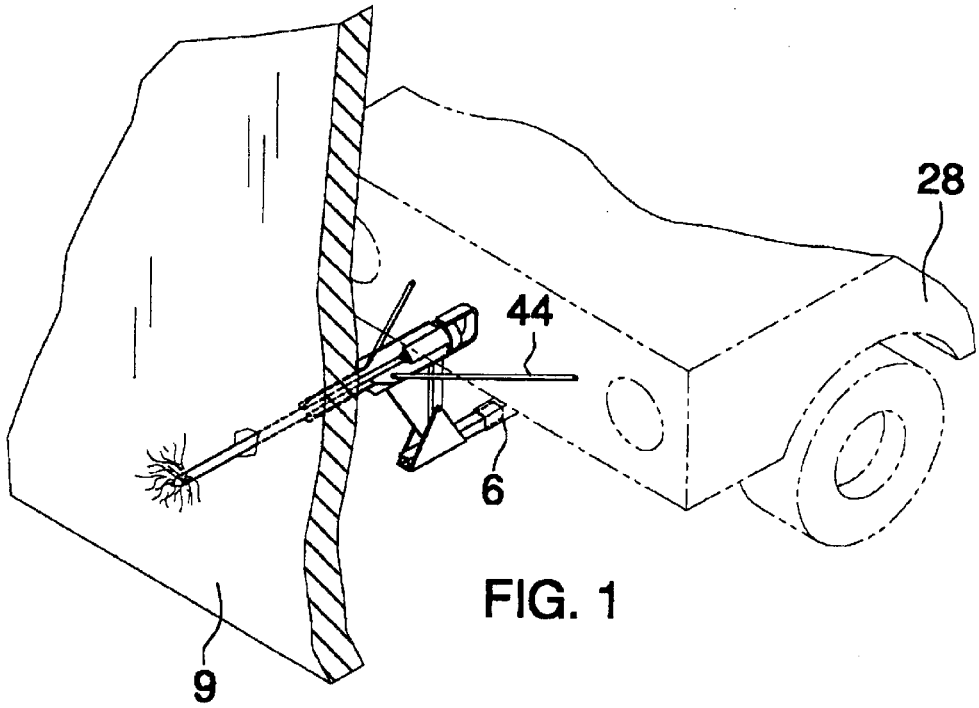
FIG. 1 is a schematic perspective view of a teargas deploying assembly according to the present invention.
Figure 2:
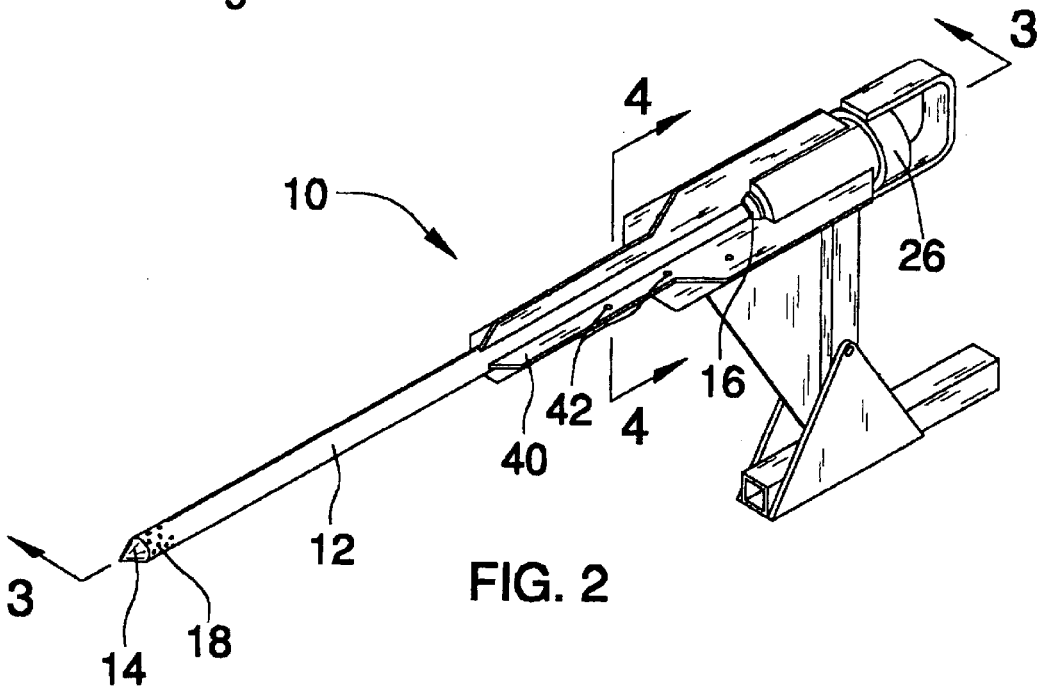
FIG. 2 is a schematic perspective view of the present invention.
Figure 3:
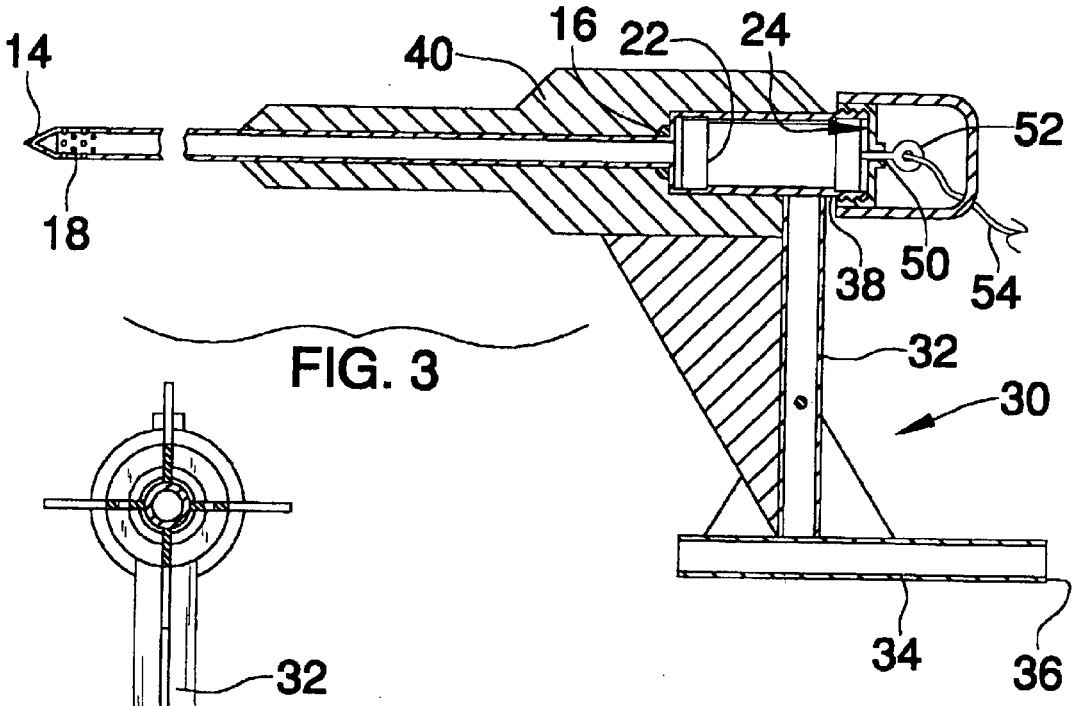
FIG. 3 is a schematic cross-sectional view taken along line 3—3 of FIG. 2 of the present invention.
Figure 4:
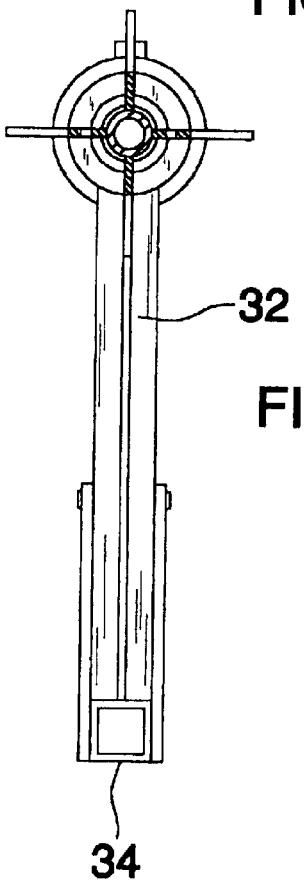
FIG. 4 is a schematic cross-sectional view taken along line 4—4 of FIG. 2 of the present invention.

With reference now to the drawings, and in particular to FIGS. 1 through 5 thereof, a new gas deploying device embodying the principles and concepts of the present invention and generally designated by the reference numeral 10 will be described.

As best illustrated in FIGS. 1 through 5, the teargas deploying assembly 10 generally comprises a device for removably mounting to a female receiver 6 on a vehicle 8. The female receiver 6 may include a conventional female hitch and is preferably attached to an armored vehicle typically used in police and military raids. The assembly 10 includes an elongated tubular member 12 having a first end 14 and a second end 16. The first end 14 is closed and has a pointed shape. The second end 16 is open. A plurality of apertures 18 extends into the tubular member 12. Each of the apertures 18 is positioned generally adjacent to the first end 14. It is preferred that the tubular member 12 have length of at least 42 inches.

A canister receiving housing 20 is fluidly coupled to the second end 16 and extends away therefrom. The housing 20 has an opening 24 positioned opposite of the tubular member 12. A teargas canister 22 may selectively be positioned through the opening and into the housing 20. A cover 26 is removably attached to the housing 20 for selectively opening or closing the opening 24. The cover 22 may be threaded for engaging threads on a peripheral wall 28 of the housing 20.

A male bracket 30 is attached to the housing 20 for removably mounting the housing 20 to the female receiver 6 such that the tubular member 12 extends away from the vehicle 8. The male bracket 30 includes a first arm 32 and a second arm 34 attached together at a generally perpendicular angle such that the first arm 32 is vertically orientated and the second arm 34 is horizontally orientated. The second arm 34 has a free end 36 that is removably extendable into the female receiver 6. The first arm 32 has an upper end 38 attached to the housing 12.

A stabilizing assembly is attached to the tubular member 12 and the housing 20. The stabilizing assembly includes a plurality of fins 40 is attached to and extending along and abutting area of the tubular member 12 and the housing 20. Each of the fins 40 radially extends outwardly from the tubular member 12 and the housing 20. The fins 40 provide added strength to the tubular member 12 and housing 20 of the assembly to ensure that they do not bend during the assembly's 10 use. Holes 42 may extend through the fins 40 for receiving rods 44 that are extended between and attached to the fins 40 and the vehicle 8 to provide additional stabilization.

Figure 5:
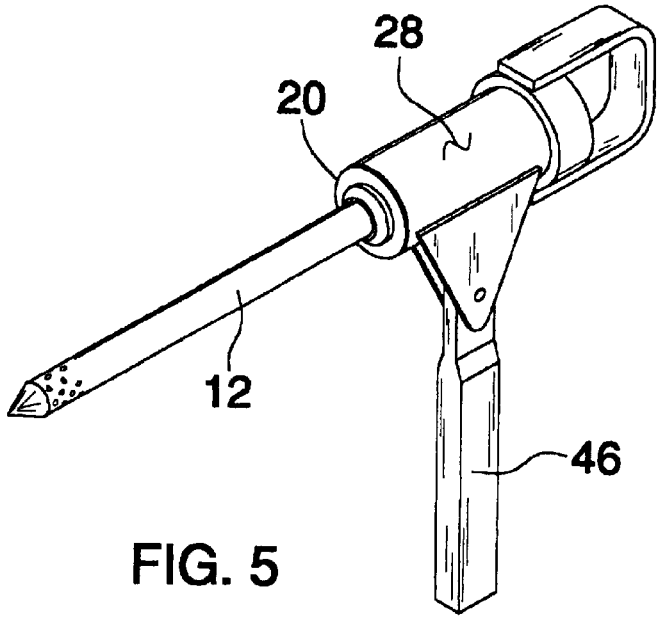
FIG. 5 is a schematic perspective view of a second embodiment of the present invention.

In use, the assembly 10 is mounted on the female receiver 6 as shown in FIG. 1. The vehicle 8 drives toward a wall 9 and the first end 14 of the tubular member 12 is extended through the wall 9. The canister 22 of teargas is opened such that teargas moves down the tubular member 12 and outward through the apertures 18. The released teargas enters a dwelling bound by the wall 9. An alternate embodiment of the device is shown in FIG. 5 and is intended for handheld use such for puncturing a door. Preferably, the covering 26 has an opening 50 extending therethrough such that an actuator pin 52 of the canister 22 extends through the opening 50. A tether 54 is attached to the pin 52 and extended away from the vehicle, or into a cabin of the vehicle so that the driver is protected while opening the teargas. The handheld version is generally the same as the vehicle mountable version though a handle 46 replaces the male bracket and its shorter length, which is preferably less than 36 inches, does not require stabilizing fins 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A teargas deploying device for removably mounting to a female receiver on a vehicle, said device being adapted for releasing teargas from a teargas canister and into a dwelling through a wall of the dwelling, said device comprising:

an elongated tubular member having a first end and a second end, said first end being closed and having a pointed shape, said second end being open, a plurality of apertures extending into said tubular member, each of said apertures being positioned generally adjacent to said first end;

a canister receiving housing being fluidly coupled to said second end and extending away therefrom, wherein the teargas canister may be removably positioned in said housing;

a male bracket being attached to said housing for removably mounting said housing to the female receiver such that the tubular member extends away from the vehicle;

a stabilizing assembly being attached to said tubular member and said housing, said stabilizing assembly including a plurality of fins being attached to and extending along and abutting area of said tubular member and said housing, each of said fins radially extending outwardly from said tubular member and said housing; and wherein said first end of said tubular member may be extended through the wall such that the teargas released from the canister may enter the dwelling.

2. The device of claim 1, wherein said housing has an opening positioned opposite of said tubular member for receiving the canister, a cover being removably attached to said housing for selectively opening or closing said opening.

3. The device of claim 1, wherein said male bracket includes a first arm and a second arm attached together at a generally perpendicular angle such that said first arm is vertically orientated and said second arm is horizontally orientated, said second arm having a free end being removably extendable into said female receiver, said first arm having an upper end attached to said housing.

4. A teargas deploying device for removably mounting to a female receiver on a vehicle, said device being adapted for releasing teargas from a teargas canister and into a dwelling through a wall of the dwelling, said device comprising:

an elongated tubular member having a first end and a second end, said first end being closed and having a pointed shape, said second end being open, a plurality of apertures extending into said tubular member, each of said apertures being positioned generally adjacent to said first end;

a canister receiving housing being fluidly coupled to said second end and extending away therefrom, said housing having an opening positioned opposite of said tubular member, wherein the teargas canister may be removably positioned in said housing a cover being removably attached to said housing for selectively opening or closing said opening;

a male bracket being attached to said housing for removably mounting said housing to the female receiver such that the tubular member extends away from the vehicle, said male bracket including a first arm and a second arm attached together at a generally perpendicular angle such that said first arm is vertically orientated and said second ar is horizontally orientated, said second arm having a free end being removably extendable into said female receiver, said first arm having an upper end attached to said housing;

a stabilizing assembly being attached to said tubular member and said housing, said stabilizing assembly including a plurality of fins being attached to and extending along and abutting area of said tubular member and said housing, each of said fins radially extending outwardly from said tubular member and said housing; and wherein said first end of said tubular member may be extended through the wall such that the teargas released from the canister may enter the dwelling.

* * * * *